US010269309B2

(12) United States Patent
Taylor et al.

(10) Patent No.: US 10,269,309 B2
(45) Date of Patent: Apr. 23, 2019

(54) PERSISTENT DISPLAY DEVICE WITH POWER HARVESTING

(71) Applicant: Microsoft Technology Licensing, LLC, Redmond, WA (US)

(72) Inventors: Stuart Alastair Taylor, Cambridge (GB); Nicholas Yen-Cherng Chen, Cambridge (GB); John Franciscus Marie Helmes, Steyl (NL); Stephen Edward Hodges, Cambridge (GB); James Scott, Cambridge (GB); Albrecht Schmidt, Satteldorf (DE); Pascal Knierim, Munich (DE); Gavin Wood, Newcastle Upon Tyne (GB); Josh Wolff Fromm, Seattle, WA (US); Tobias Grosse-Puppendahl, Cambridge (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 66 days.

(21) Appl. No.: 14/874,896

(22) Filed: Oct. 5, 2015

(65) Prior Publication Data

US 2017/0098416 A1 Apr. 6, 2017

(51) Int. Cl.
*G09G 3/34* (2006.01)

(52) U.S. Cl.
CPC ..... *G09G 3/344* (2013.01); *G09G 2300/0473* (2013.01); *G09G 2310/04* (2013.01); *G09G 2320/066* (2013.01); *G09G 2320/0666* (2013.01); *G09G 2330/021* (2013.01); *G09G 2330/023* (2013.01); *G09G 2340/0435* (2013.01); *G09G 2360/08* (2013.01); *G09G 2370/16* (2013.01)

(58) Field of Classification Search
None
See application file for complete search history.

(56) References Cited

U.S. PATENT DOCUMENTS 8,264,194 B1 9/2012 Spangler et al.
2004/0113903 A1* 6/2004 Mikami ..... G09G 3/344 345/204

(Continued)

FOREIGN PATENT DOCUMENTS

WO PCT/IB2013060248 * 11/2013 ..... H04M 1/0283
WO WO2015075500 * 5/2015 ..... H04M 1/0283

OTHER PUBLICATIONS

Anthony, Sebastian, "MIT Startup Makes Transparent Solar Panel That Will Allow Your Smartphone to Power Itself", Published on: Feb. 25, 2013 Available at: http://www.extremetech.com/extreme/149163-mit-startup-makes-transparent-solar-cells-that-will-allow-your-smartphone-to-power-itself.

(Continued)

*Primary Examiner* — Ifedayo B Iluyomade

(57) ABSTRACT

A display device which includes an electronic paper display additionally comprises power harvesting hardware and display update hardware which is configured to control the updating of the electronic paper display based on a sensed power harvesting level which may, in various embodiments, be a current incoming power level as generated by the power harvesting hardware or a stored power level in a power storage device within the display device.

18 Claims, 9 Drawing Sheets

(56) References Cited

U.S. PATENT DOCUMENTS

| | | | | |
|---|---|---|---|---|
| 2005/0280627 | A1* | 12/2005 | Koshimizu | B41J 3/4076 345/156 |
| 2007/0030243 | A1 | 2/2007 | Ishii | |
| 2007/0030244 | A1 | 2/2007 | Ishii | |
| 2011/0084951 | A1 | 4/2011 | Karhuketo et al. | |
| 2011/0241843 | A1 | 10/2011 | Marsanne et al. | |
| 2012/0287095 | A1 | 11/2012 | Cote et al. | |
| 2014/0266632 | A1 | 9/2014 | Jones et al. | |
| 2014/0268303 | A1 | 9/2014 | Uysal et al. | |
| 2016/0042678 | A1* | 2/2016 | Liu | G09G 3/20 345/205 |
| 2016/0275879 | A1* | 9/2016 | Hodges | G06F 3/147 |
| 2016/0301785 | A1* | 10/2016 | Espinoza | H02J 7/025 |

OTHER PUBLICATIONS

Ostaffe, Harry, "RF-based Wireless Charging and Energy Harvesting Enables New Applications and Improves Product Design", Published on: Oct. 2, 2012 Available at: http://www.mouser.com/applications/rf_energy_harvesting/.

Bishop, Bryan, "SolarKindle Uses Sunlight to Power your E-Reader", Published on: Jan. 7, 2012 Available at: http://www.theverge.com/2012/1/7/2690846/solarkindle-sunlight-powered-case-price-79-99.

Mandal, Sovan, "LG's New E-Reader is Solar Powered", Published on: Mar. 16, 2010 Available at; http://goodereader.com/blog/electronic-readers/lgs-new-e-book-reader-is-solar-powered.

Dementyev, et al., "Wirelessly Powered Bistable Display Tags", In Proceedings of the ACM international joint conference on Pervasive and ubiquitous computing, Sep. 8, 2013, 4 pages.

Linder, Brad, "Bookeen to Launch Solar-Powered Ereader in 2016", Published on: Mar. 3, 2015 Available at: http://liliputing.com/2015/03/bookeen-to-launch-solar-powered-ereader-in-2016.html.

Swedberg, Claire, "Researchers Develop Energy-Harvesting NFC Tag With Sensors, E-Paper Display", Published on: Aug. 8, 2013 Available at: http://www.rfidjournal.com/articles/view?10941.

"E-Reader Going Green_ Biblio Leaf", Published on: Mar. 22, 2011 Available at: http://www.alternative-energy-news.info/e-reader-biblio-leaf/.

Kozlowski, Michael, "Shake to Charge Battery", Published on: Feb. 17, 2012 Available at: http://apps.goodereader.com/android-apps/business-and-productivity-apps/?did=1460.

"International Search Report and Written Opinion Issued in PCT Application No. PCT/US2016/053853", dated Dec. 20, 2016, 11 Pages (MS# 357733-WO-PCT).

* cited by examiner

PERSISTENT DISPLAY DEVICE WITH POWER HARVESTING

BACKGROUND

Electronic paper (or e-paper) is used for e-reader devices because it only requires power to change the image displayed and does not require continuous power to maintain the display in between. The electronic paper can therefore hold static images or text for long periods of time (e.g. from several minutes to several hours and even several days, months or years in some examples) without requiring significant power (e.g. without any power supply or with minimal power consumption). There are a number of different technologies that are used to provide the display, including electrophoretic displays, electrochromic and electrowetting displays. Many types of electronic paper display are also referred to as "bi-stable" displays because they use a mechanism in which a pixel can move between stable states (e.g. a black state and a white state) when powered but holds its state when power is removed.

SUMMARY

The following presents a simplified summary of the disclosure in order to provide a basic understanding to the reader. This summary is not intended to identify key features or essential features of the claimed subject matter nor is it intended to be used to limit the scope of the claimed subject matter. Its sole purpose is to present a selection of concepts disclosed herein in a simplified form as a prelude to the more detailed description that is presented later.

A display device which includes an electronic paper display additionally comprises power harvesting hardware and display update hardware which is configured to control the updating of the electronic paper display based on a sensed power harvesting level which may, in various embodiments, be a current incoming power level as generated by the power harvesting hardware or a stored power level in a power storage device within the display device.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
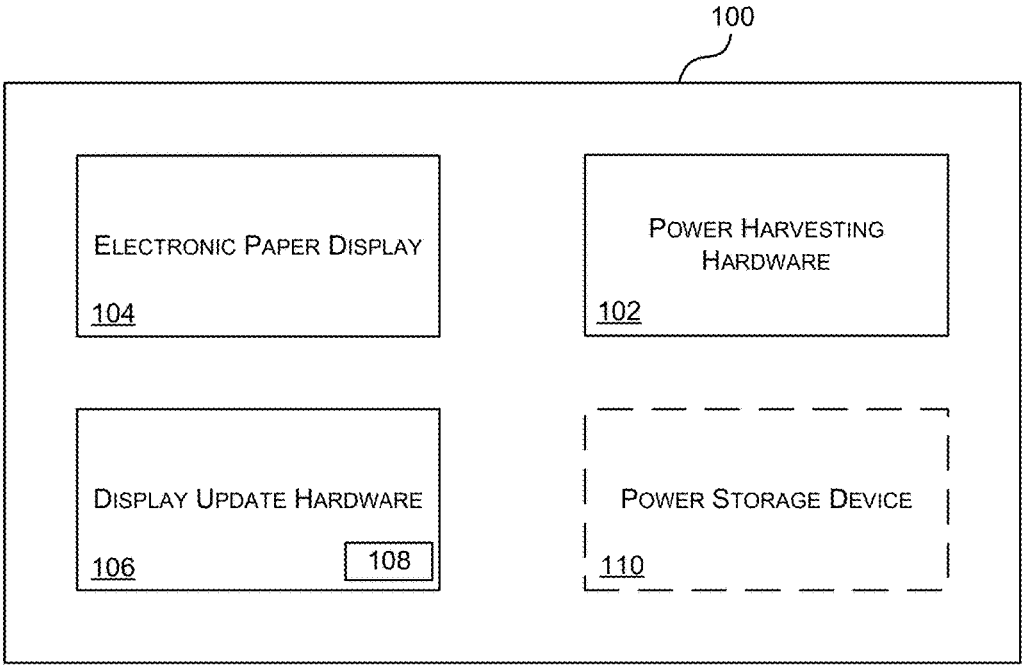
FIG. 1 is a schematic diagram of an example display device comprising power harvesting hardware.

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

E-reader devices often use a bi-stable display because they have much lower power consumption than backlit liquid crystal displays (LCDs) or LED displays which require power to be able to display content. In contrast, a bi-stable display requires power to change state (i.e. change the image/text displayed) but does not require power to maintain a static display. This enables the display to be "always on" (i.e. always displaying content, in contrast to emissive displays which typically have a power saving mode when the display is switched off). Although such e-reader devices do not need to be charged as frequently as a device which comprises an emissive display, they still need to be charged occasionally (e.g. every few weeks) and this requires a user to manually connect them to an electrical power source.

The embodiments described below are not limited to implementations that solve any or all of the disadvantages of known display devices.

Described herein is a display device which comprises an electronic paper display, power harvesting hardware and display update hardware. The power harvesting hardware recovers (e.g. captures or generates) power from the environment (e.g. the ambient light, direct light, cellular or other wireless signals, vibrations or other motion of the device, bending or deformation of the device, the ambient temperature) so that the display device does not require a user to manually plug it in or place it on a wireless charging base to charge it or require a permanent wired connection to an external power source. The display update hardware controls the updating of the electronic paper display (e.g. when and/or how it is updated) based on a sensed power harvesting level.

Such a display device can be truly "always on" and may not require any user intervention to charge the device (as is required by conventional e-reader devices as well as display devices comprising emissive displays). There may be some user intervention required (e.g. to place the device in an improved position/location to improve the power harvesting) however a user does not need to connect the display device to an external power source (e.g. to an external battery or to mains electricity).

Such a display device can be very thin and light and depending upon the electronic paper display technology used, can also be flexible. The display device may be of any size. For example, it may be small like a credit or business card (or smaller, like a postage stamp or price label), medium sized like an A4 sheet of paper, or much larger like a poster, noticeboard or billboard. It may have any shape and need not be square or rectangular.

There are many different applications for such a display device and the display device may, for example, be part of a wearable device (e.g. integrated into a piece of clothing, jewellery or other object that can be worn by a user on their person or attached to their clothing or accessories). The "always on" nature of the display device may make it particularly suitable for certain applications, such as part of a device which must be dustproof, waterproof or otherwise sealed and so cannot accommodate a traditional socket for receiving a power lead (where the socket may provide a path for the ingress of dirt, moisture, etc.).

The "always on" nature of the display device may make the display device particularly suitable for use in particular locations, such as a display installed in an inaccessible (but yet viewable) location, a location where it is difficult to provide mains power, or where one wishes to avoid the cost of installing mains power. It may further be used where the screen is mobile or portable and one wishes to avoid the inconvenience of charging it (during which it is not portable) and the weight and cost of incorporating a battery large enough to hold that charge for an operating period.

The "always on" nature of the display device may make it easier and/or faster for the user to consult the device for information as it requires less user interaction to access the information. For example, simple glancing may be enough instead of requiring them the trigger the device to exit from a reduced power state (e.g. as is typically the case for emissive displays and is also the case for electronic paper displays which have not been used for a period of time).

The term "electronic paper" is used herein to refer to display technologies which reflect light (like paper) instead of emitting light like conventional LCD displays. As they are reflective, electronic paper displays do not require a significant amount of power to maintain an image on the display and so may be described as persistent displays. Many electronic paper displays are multi-stable displays. In some display devices, an electronic paper display may be used together with light generation in order to enable a user to more easily read the display when ambient light levels are too low (e.g. when it is dark). In such examples, the light generation is used to illuminate the electronic paper display to improve its visibility rather than being part of the image display mechanism and the electronic paper does not require light to be emitted in order to function.

The term "multi-stable display" is used herein to describe a display which comprises pixels that can move between two or more stable states (e.g. a black state and a white state and/or a series of grey or colored states). Bi-stable displays, which comprise pixels having two stable states, are therefore examples of multi-stable displays. A multi-stable display can be updated when powered, but holds a static image when not powered and as a result can display static images for long periods of time with minimal or no external power. Consequently, a multi-stable display may also be referred to as a "persistent display" or "persistently stable" display. An electrophoretic ink layer is an example of a multi-stable layer which can be changed (or controlled) by applying electric fields. Other examples include a cholesteric liquid crystal layer or a bi-stable electrowetting display layer which is controlled using electric fields or currents applied via electrodes on the faces of a the layer.

FIG. 1 is a schematic diagram of an example display device 100 comprising power harvesting hardware 102. The display device 100 also comprises an electronic paper display 104 and display update hardware 106. The display update hardware 106 is configured to control the updating of the electronic paper display 104 based on a sensed power harvesting level. This level may be sensed by a sensor 108 which may be integral to, or separate from, the display update hardware 106. As also shown in FIG. 1, the display device 100 may, in various examples, also comprise a power storage device 110, such as a battery. In other examples, however, there may be no power storage capability.

The power harvesting hardware 102 recovers energy from the environment i.e. from the surroundings and/or any motion of the display device 100. In various examples the power harvesting hardware 102 may recover energy from one or more of:

- light energy (e.g. the ambient light which may come from the sun or an artificial light source such as a light bulb, LED or fluorescent tube light);
- NFC;
- cellular signals (e.g. GSM or other cellular signals emitted by a proximate cellular device such as a smart phone or a cellular base station);
- thermal energy (e.g. using a Peltier or similar device to generate an electrical current from a temperature difference between the ambient temperature external to the display device and the internal temperature of the display device);
- ultrasound; and
- mechanical/kinetic energy (e.g. as a result of motion, bending or deformation of the display device which may, for example, be the direct consequence of user interaction with the display device such as the user shaking the device, or user motion, such as the user walking, running or travelling in/on a moving vehicle such as a car or bicycle or vibration of the display device).

Where NFC or cellular harvesting is used, the signals may be emitted by a separate proximate device, such as a smart phone, as a consequence of other activities performed on the proximate device (e.g. a user downloading data, searching the web, using NFC based payment schemes, etc.). In some examples, a user may actively trigger the emission of the NFC/cellular signals for the specific purpose of charging the display device described herein (e.g. by pushing a specific software 'top-up charge' button on the proximate device).

The power harvesting level which is sensed by the display update hardware 106 (e.g. by sensor 108) may be an indicator of the amount of power currently being harvested by the power harvesting hardware 102 (e.g. an incoming power level) or an amount of locally stored energy (e.g. an amount of energy stored in the power storage device 110 which is connected to and charged by the power harvesting hardware 102 either exclusively or in combination with another power source), or a combination of the two (e.g. a combination of an indicator of the amount of power currently being harvested and a locally stored amount of energy).

In addition to using one or both of these to control the updating of the display 104, the display update hardware 106 may control the updating of the display 104 based, in part, on a prediction of a future charging level or opportunity. For example, if the power harvesting hardware 102 generates power from ambient light and it can be predicted (e.g. based on past sensed levels) that the ambient light level or the power harvesting level will increase at a specific time, this may influence the control of the display updates. For example, if it is predicted that the power harvesting level will increase significantly within the next X minutes (where $X<60$) then an update may be performed at a lower sensed power harvesting level than if it was not known when or if the power harvesting level was likely to rise or if it was predicted that the power harvesting level would not rise for a much longer period of time (e.g. several hours, such that X>180). This might for example enable the display to be updated shortly before sunrise, but not shortly after sunset.

Figure 2:
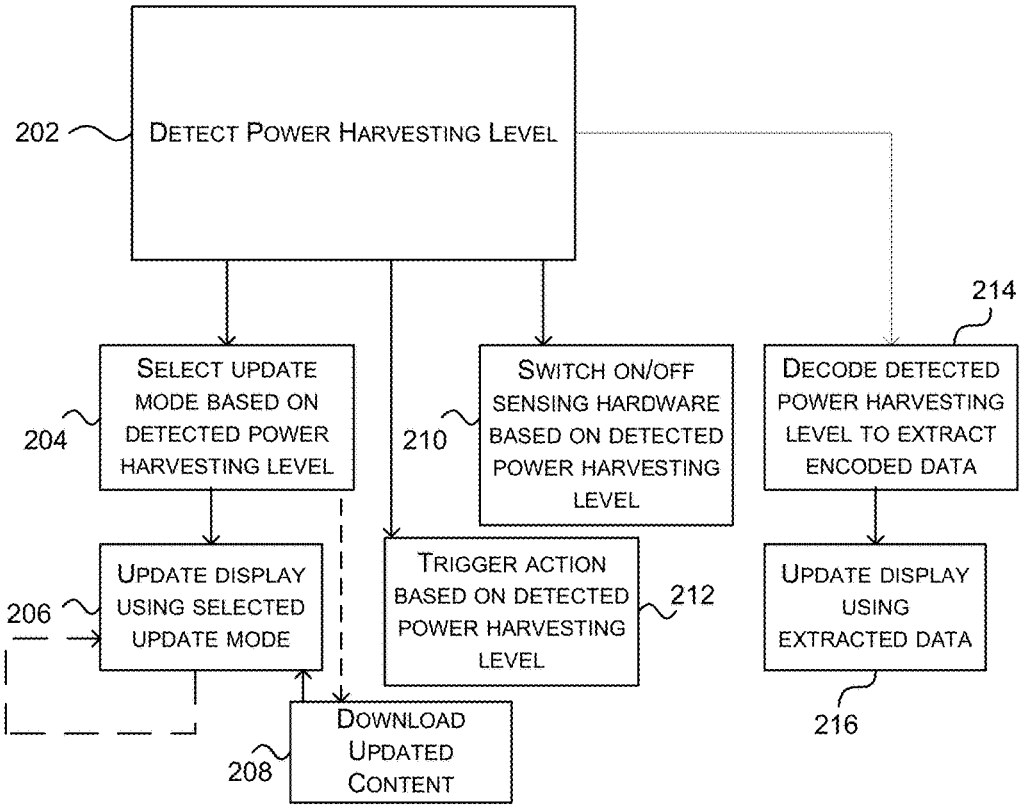
FIG. 2 is a flow diagram of an example method of operation of display update hardware in a display device comprising power harvesting hardware.

FIG. 2 is a flow diagram of an example method of operation of the display update hardware 106. As described above, the display update hardware 106 detects a power harvesting level (block 202). Based on the sensed level, the display update hardware 106 selects an update mode (block 204) and then updates the display using the selected update mode (block 206).

There are many different update modes that may be selected (in block 204) and used (in block 206) and various examples are described below. In all examples, the selection that is made (in block 204) based on the sensed level is from a set of candidate update modes which comprises at least two candidate update modes and where the term 'candidate update mode' is used to refer to any update mode which can be selected in block 204. One of these candidate update modes may be a "no update mode" in which no update is performed in block 206 (i.e. such that an update mode does not necessarily result in an update to the displayed content but instead describes if/when and/or how the displayed content may be updated). In various examples one of the candidate update modes may involve not only updating the display based on locally stored content (i.e. content stored in a content store within the display device 100 and not shown in FIG. 1) but also downloading updated content (block 208). The downloaded content (from block 208) may be used immediately in the following updating step (in block 206) or at a later time in a further updating step (e.g. in a subsequent iteration of the method shown in FIG. 2).

The update mode that is selected in block 204 may be a progressive update mode, and the set of candidate update modes may comprise one or more progressive update modes. A progressive update mode is one where the new or updated content does not appear immediately in its final form when an update is performed but instead the content either appears gradually over the course of a plurality of display updates or changes to its final form over a series of two or more updates. Examples of progressive update modes are described below.

Figure 3:
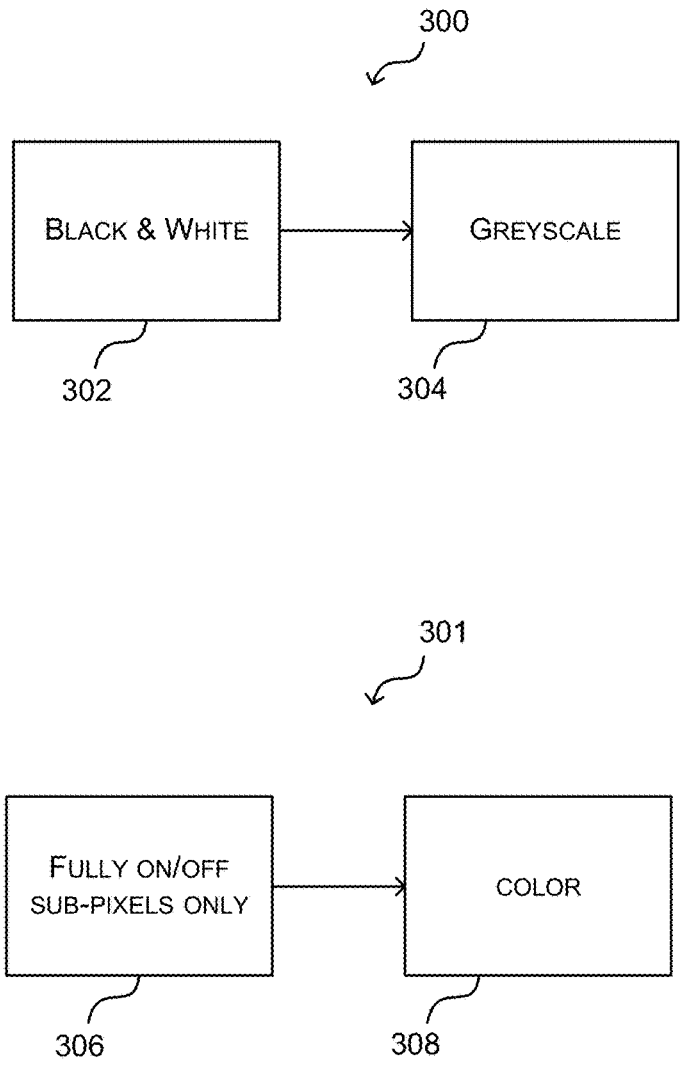
FIG. 3 is a schematic diagram illustrating two example progressive update modes.

A first example progressive update mode 300 is shown in FIG. 3. In this update mode 300 an image (or other content) is initially rendered in black and white 302 and then is subsequently rendered (in another update) in greyscale 304. In another example 301, a display capable of showing color may first show only colors represented by fully-on/fully-off subpixels 306 (i.e. the case of RGB subpixels, this results in 8 options: white, black, red, green, blue, cyan, magenta and yellow) and subsequently, following another update the content may be rendered in color 308. Both color and greyscale images may also use further levels of progression, e.g. where only a few levels of grey/few levels of color (for each color sub-pixel) are used initially but further levels are then added.

Figure 4:
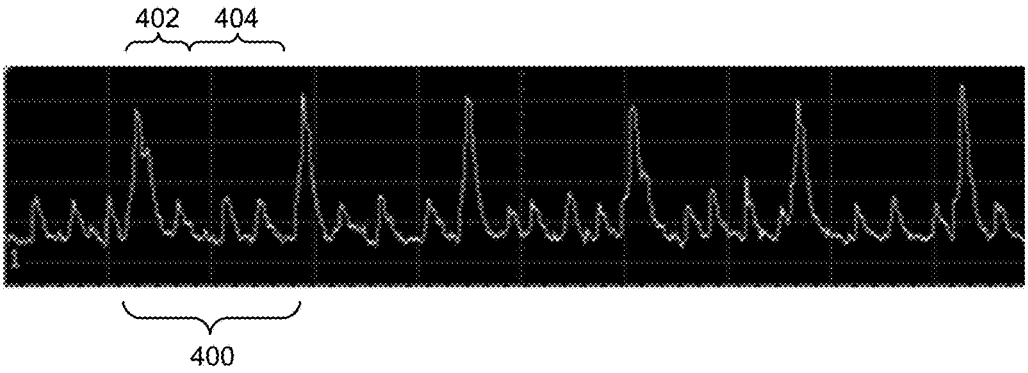
FIG. 4 is a schematic diagram illustrating a further example progressive update mode.

In a further example progressive update mode, instead of using the full driving (or update) waveform for an update operation where this waveform 400 may, for example, comprise a number of updates (or pixel pulses) for each pixel as shown in the example of FIG. 4, the pixel pulses of the driving waveform are applied gradually over a number of updates. In an example, in a first update, each pixel in the display may be driven using the first section 402 of the waveform, in a next update each pixel in the display may be driven using the next section 404 of the waveform, etc. until each pixel has been driving using the entire update waveform 400 (i.e. all the pixel pulses in the waveform).

A set of candidate update modes may include one or more of these further example update modes and where there are two or more, different candidate update modes may divide the full waveform into sections differently (e.g. comprising different numbers of pixel pulses). For example, a first mode may apply the waveform in fewer, larger sections (i.e. over fewer updates) than a second mode which divides the waveform 400 into a larger number of smaller sections which are applied over a larger number of updates.

In another example progressive update mode, the refresh rate of the display 104 may be varied and again a set of candidate update modes may include two or more of such update modes with different refresh rates.

In a further example progressive update mode, a reduced image set may be rendered. This reduced image set may, for example, only be the outline of an image, with the detail being filled in subsequently, or may be the headings (and sub-headings) in a block of text with the text appearing in subsequent updates. The reduced image set may be generated by the display update hardware 106 or elsewhere within the display device 100 or may be generated outside of the display device 100 (e.g. on a device which provides content to the display device, such as a central server or user computing device) in response to a signal (e.g. a request) sent by the display update hardware 106 to the content generating device.

In another example progressive update mode, only a proper subset of the pixels in the display 104 may be updated in an update operation. For example, in a first update only half of the pixels may be updated (e.g. alternate rows in the display) with the remaining pixels being updated in a second update operation. The choice of which pixels are updated (i.e. how the pixels in the display 104 are divided into a plurality of non-overlapping subsets) may be dependent upon the particular technology used for the display 104. This is because for some technologies there may be some subsets of pixels which, when written to, use the same amount of power as updating all the pixels (e.g. for many technologies, updating alternate columns of pixels is a particularly high power operation) and other subsets of pixels which can be written to using significantly less power. In various examples, the subsets may be defined such that updating all the pixels in a subset consumes significantly less power than updating all the pixels in the entire display (e.g. such that the power consumed by updating all of the subsets in turn is not significantly larger than the power consumed by updating all of the pixels in the display in a single operation).

For example, in EPDs with shared gate signal on columns and shared source signal on rows, it is very inefficient to update two horizontally adjacent pixels to opposite colors. However, alternating vertical pixels has little effect. For such a display, there may be two proper subsets defined, each comprising alternate columns of pixels (e.g. the first subset comprising the odd columns and the second subset comprising the even columns of pixels) and one subset may be updated first, followed by the other subset. Similarly, if the gate and source axes were swapped the opposite would be true, i.e. it would be very inefficient to update two vertically adjacent pixels to opposite colors and for such an EPD there may be two proper subsets defined, each comprising alternate rows of pixels (e.g. the first subset comprising the odd rows and the second subset comprising the even rows of pixels) and one subset may be updated first, followed by the other subset.

The subset of pixels may be selected based on their position in the display (e.g. which row/column they are part of, as in the examples above) and/or their current state (e.g.

black/white for a black and white display). Where the subsets are defined based (at least in part) on a current state of a pixel, which pixels are in a particular subset will not be fixed but will change dependent upon the content displayed.

This type of a progressive update mode in which only a proper subset of the pixels in the display 104 are updated in a single update operation may also be described as a partial update mode. In another example of a partial update mode, the updated content may be rendered at a smaller size on only a portion of the display (e.g. on one half or one quarter of the display) with the rest of the pixels (e.g. the remaining half or three quarters of the pixels in the display) being blanked (i.e. set to a default state which may, for example, be white or black) or left unchanged. A set of candidate update modes may include one such update mode (e.g. which renders the image half size on half of the display and so only requires half of the total number of pixels to be updated). Alternatively, a set of candidate update modes may include two or more of such update modes enabling different sizes of image (or other content) to be updated based on the sensed power harvesting level.

Figure 7:
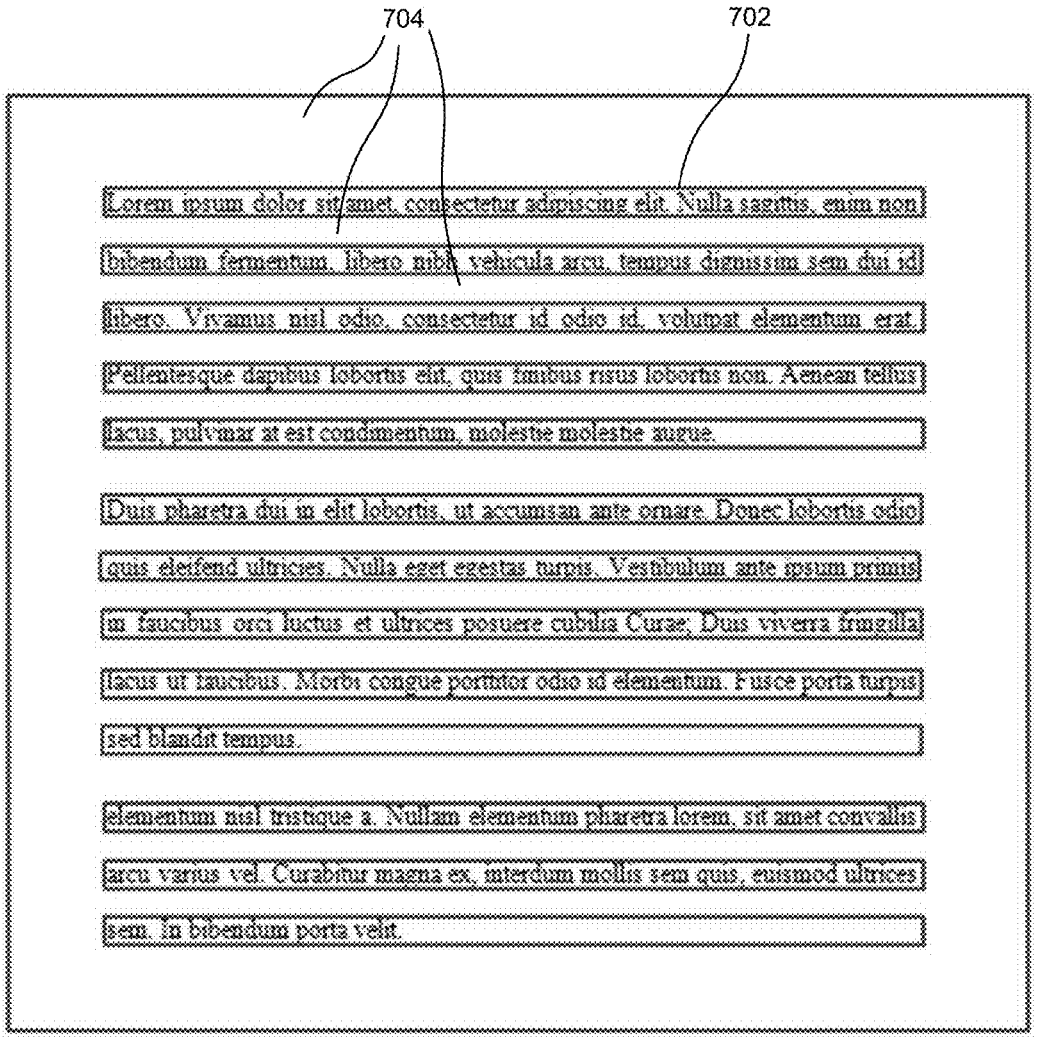
FIG. 7 is a schematic diagram illustrating a partial update mode.

A further example of a partial update mode is shown in FIG. 7 which may alternatively be referred to as a selective update mode. The selective update is performed based on the content presented, e.g. text rendering where only the lines that contain text (as indicated by the boxes 702 in FIG. 7) are updated but not the white spaces 704. Specific layouts (e.g. spacing between lines and spacing between paragraphs) may be used to ensure that the white space is not moved.

In a further example update mode, a voltage which is lower than the normal update voltage may be used to perform the update. In an example the low voltage may be selected to be sufficiently low that the PMIC (power management integrated circuit) within the display device 100 is not powered up and the circuitry may be configured to enable the display to be driven without using the PMIC. The use of such a low voltage may reduce the image quality compared to using the standard update voltage for the display 104, but results in energy saving (e.g. through the combination of the lower voltage and the elimination of the power losses due to the inefficiency of the PMIC).

In another example update mode, the nature of the updated content (or the user interface) may be modified to reduce the power required to display a change in the content. For example, such that, instead of erasing an element of the content, a strikethrough (or other scratching out of the text) is used or by changing contrasts/greyscales or using a different font or adding an icon (e.g. arrows to re-direct attention) etc. This update mode may only be suitable for some types of content (e.g. text). As with the example progressive update mode which used a reduced image set (as described above), the modified content may be generated by the display update hardware 106 or elsewhere within the display device 100 or may be generated outside of the display device 100 (e.g. on a device which provides content to the display device, such as a central server or user computing device) in response to a signal (e.g. a request) sent by the display update hardware 106 to the content generating device.

Figure 5:
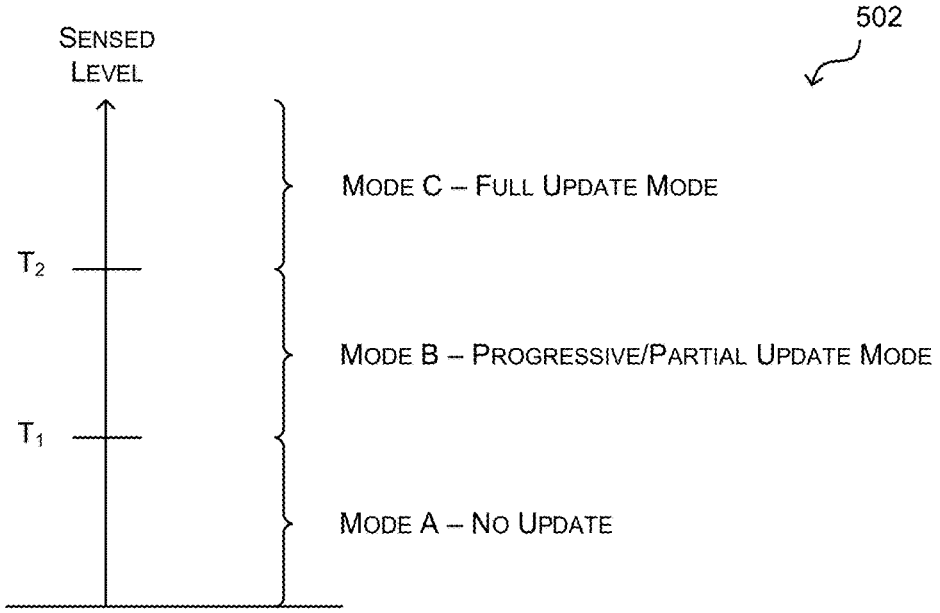
FIG. 5 shows schematic diagrams of how an update mode may be selected based on the sensed level.
Figure 5:
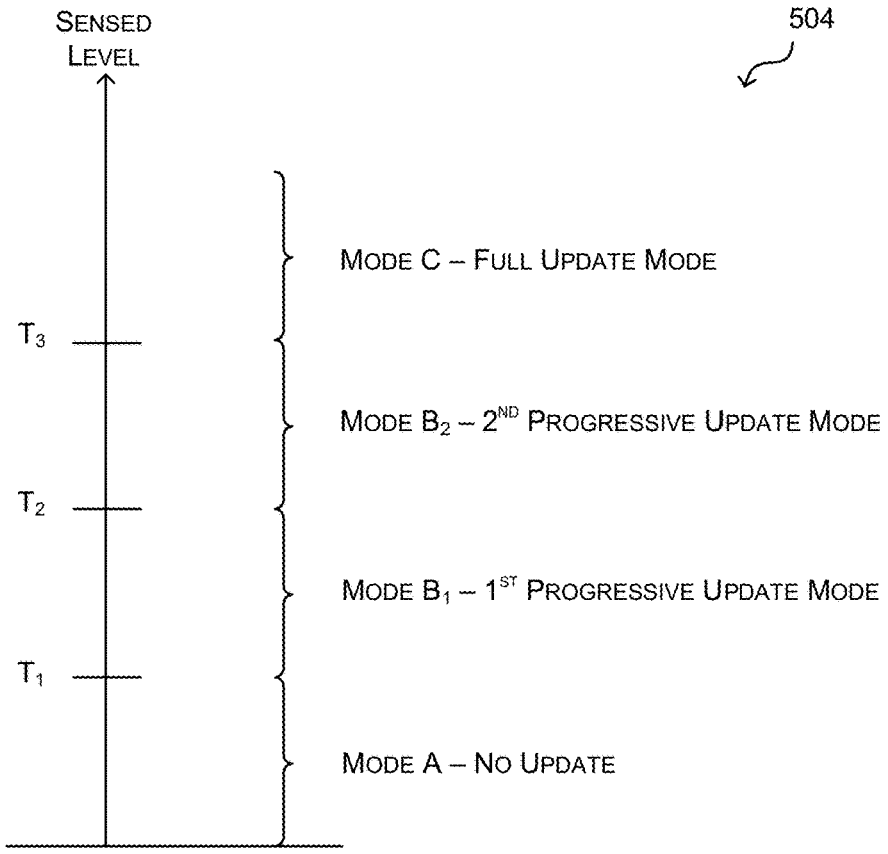

FIG. 5 shows schematic diagrams of how the update mode may be selected based on the sensed level. In the first example 502, if the sensed power harvesting level is less than a lower threshold, $T_1$, a "no update" mode (Mode A) is selected. If however, the sensed level is above a higher threshold, $T_2$, an update mode is selected which performs a full update (Mode C), including checking new content to download (in block 208). For sensed levels between the two thresholds, a partial or progressive update mode (such as one of the examples described above) may be selected.

In examples where a partial or progressive update mode is used, more than one update may be performed without re-detecting the power harvesting level (e.g. block 206 in FIG. 2 may be repeated, as indicated by the dotted arrow). The number of updates operations which are performed (e.g. successively without re-sensing the power harvesting level) may depend on the sensed level (from block 202), with higher sensed levels triggering more successive update operations than lower sensed levels and the time interval between update operations may be fixed or variable (e.g. with lower sensed levels having larger time intervals between updates). In addition, or instead, the method of FIG. 2 may be repeated (i.e. re-detecting the sensed level, selecting an update mode and then performing an update based on the selected update mode) periodically, with the time interval between repetitions being fixed or variable.

In the second example 504 shown in FIG. 5, there are three thresholds $T_1$, $T_2$, $T_3$ which are used to determine which update mode is selected and in this example there are two different progressive/partial update modes in the set of candidate update modes.

In the two examples, shown in FIG. 5 (and in various other examples), any update to the display is prevented when the sensed level falls below a particular threshold ($T_1$ in the examples shown). This threshold may be set based on the required minimum power to perform an update (i.e. such that an update cannot physically be performed if the sensed power level is less than the threshold) or the threshold may be set above this level. Where a higher value is used for this lowest threshold, $T_1$, this may, for example, be implemented to ensure that the display always has enough residual stored power (where the display device includes a battery) to erase the display. This may, for example, be used where the displayed content is sensitive in nature or has an expiry date (e.g. where it has been borrowed from a third party). In such an example the display update hardware 106 may trigger the erasing of the content when the expiry date/time is reached and the specified threshold for updates other than to erase the content ensures that this is always possible.

In some examples where the sensed level indicates a current power harvesting level (rather than an amount of stored power within a power storage device 110 within the display device 100) an update may be prevented when the sensed level falls below a particular threshold even where there is sufficient stored power in the power storage device 110 within the display device 100. In various examples, the prevention of updates for sensed levels below the threshold acts as a power saving mechanism because the low sensed power harvesting level may indicate that the user is no longer consuming (or able to consume) the content displayed on the electronic paper display 104 (e.g. because it is dark, as indicated by a low power harvesting level output by light harvesting hardware, and the user cannot therefore see the display or because the display device is not moving, indicated by a low power harvesting level output by kinetic energy harvesting hardware, and so cannot be being held, and hence be visible by a user).

In the examples shown in FIG. 5 it is the absolute value of the sensed level that is used to select the update mode. In other examples, however, changes in the sensed level may be used to select an update mode. This may, for example, be used so that a display update is triggered when there is a large change (e.g. a large step change) in the sensed level, e.g. such that the display update hardware 106 only switches from a "no update" mode to a "full update" mode (or an intermediate progressive/partial update mode) where the change in sensed level exceeds a threshold. This may take into consideration whether the change is positive or negative or may just look at the magnitude of the change and not the sign of the change.

In an example implementation, a step change in the power harvesting level may be used to trigger a content update such that a display device displays a new image each day (or each time the lights in a room are switched on or off). This may, for example, be used as a security feature, to wipe displayed content once a meeting room is no longer in use (e.g. as indicated by the lights being switched off) or to enable regular automatic updates of the content displayed.

In the examples described above (e.g. with reference to FIG. 5), the sensed level, or a change in that sensed level, is used directly to select the update mode (e.g. by applying one or more thresholds to the sensed level). In other examples, however, the sensed level may be provided as an input to an algorithm which tracks and updates a user-related state variable (e.g. user absent or present) and this user-related state variable is used to select the update mode. In such examples, the updating of the electronic paper display is still controlled based on the sensed power harvesting level; however the link between the sensed level and the update mode selected is less direct and there may be other inputs to the algorithm which tracks and updates the user-related state variable (e.g. an output from a movement sensor). For example, a display may only be updated when two criteria are both met only one of which is dependent upon the sensed level, e.g. when movement is detected in a room (using a movement sensor) and the lights in the room are on (as determined from the power harvesting level).

In the examples described above, the use of particular update mode (in block 206) may provide an implicit indication to the user of the power harvesting level. For example, if the user can see that an update mode other than a full update has been performed (in block 206), this informs the user that the power harvesting level is less than optimum and may cause the user to re-locate the display device or otherwise modify the environment around the display device to improve the energy harvesting e.g. by moving the display device into the sun (where ambient light/solar power is used), by moving the display device (where kinetic energy is harvested), etc.

In some examples, the display device may, as part of the update, provide an explicit indication to the user of the power harvesting level e.g. in terms of a number indicating the number of update operations that can be performed or a bar chart or numerical value indicating the sensed power harvesting level.

Figure 6:
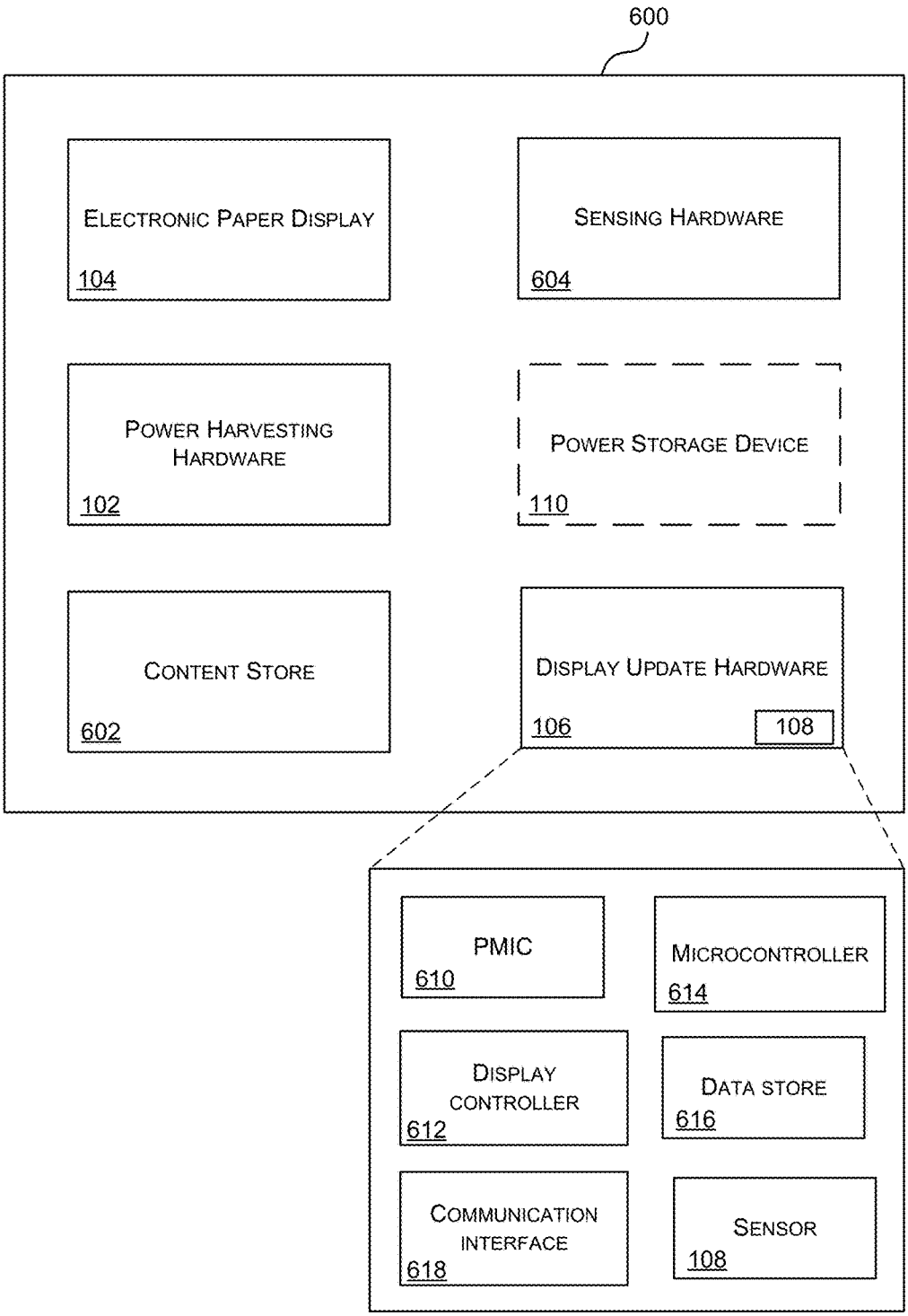
FIG. 6 is a schematic diagram of another example display device comprising power harvesting hardware.

FIG. 6 is a schematic diagram of another example display device 600. The display device 600, like the device shown in FIG. 1 and described above comprises an electronic paper display 104, power harvesting hardware 102, display update hardware 106 (and an associated sensor 108 for sensing the power harvesting level) and optionally a power storage device 110. The display device 600 also comprises a content store 602 which is arranged to store content for display on the electronic paper display 104 and sensing hardware 604.

As shown in FIG. 2 (and in addition to or instead of selecting an update mode in block 204), the sensing hardware 604 is switched on and off by the display update hardware 106 based on the sensed power harvesting level (block 210). In particular, when the sensed level is low, the sensing hardware 604 is switched off and when the sensed level is high (e.g. above a threshold value), the sensing hardware 604 is switched on.

The sensing hardware 604 may, for example, comprise a touch sensing overlay for the electronic paper display 104, proximity sensing hardware, voice detection hardware etc. The sensing hardware 604 may provide additional inputs (e.g. use inputs) to software running on the display device 600 and the sensed power harvesting level may be used as an indicator of whether a user is likely to be interacting with the display device and/or reading the display in the near future or not. For example, if the power harvesting hardware 102 generates power from ambient light, and if the sensed energy harvesting level is low, this indicates that the display device is in the dark and so a user is unlikely to be interacting with the display (as they cannot see it).

In the display device 600 shown in FIG. 6, the sensed power harvesting level acts as an input which, as well as (or instead of) being used in the control of the updating of the display 104, is also used to trigger an action which in the example described is the switching on and off of the sensing hardware 604. In other examples, the sensed power harvesting level may additionally or instead be used to trigger other actions (block 212) and may, for example, be used as a direct input signal by the user. These other actions may be display-related, for example, a user may deliberately "shadow" a solar panel by waving in front of it, to signal "please update the display device now", or similar. In other examples, these other actions may trigger actions which are less closely linked to the content displayed. For example, where the identity of a viewer is used to customize content displayed on the display device, an increased sensed power harvesting level where NFC or cellular harvesting is used, might indicate a nearby user and trigger some sort of scanning for nearby device IDs and these device IDs may be used as a proxy for user ID and used to customize the displayed content. The scanning may, for example, be over NFC or another type of ID (e.g. Wi-Fi MAC with highest signal strength, or an RF "fingerprint" of the antennas of the device, which might be NFC tuned frequency, or NFC power level delivered, or NFC duty cycle, or otherwise). The ID may in various examples be a non-unique fingerprint (e.g. detecting the NFC chip by its behavior) which still provides enough clues to do something context-specific for that user.

In various examples, the sensed power harvesting level acts as an input which controls the updating of the display (e.g. by triggering the switching between different display update modes) and also acts as an input which changes other aspects of the display. For example, a sensed power harvesting level from a solar panel could be used to sense the placement of the display device in an outdoor situation, and an outdoor mode might be triggered, which may change the application-layer use of the display (e.g. show an outdoor activity related timetable rather than a rainy-day timetable). In another example, the image displayed may be customized to optimize for the lighting conditions (based on the sensed power harvesting level from a solar panel), e.g. when outdoors (e.g. in 'outdoors mode' as selected based on the sensed power harvesting level), the font may be bigger and in high-light environments, may be black-text-on-white so that it is easier to read and when indoors (e.g. in a low-light environment as detected using the sensed power harvesting level), may be white-text-on-black so again it is easier to read (and the font size may also change). In another example, the sensed power harvesting level may be used to determine when a user's phone is close by (and hence the user is also likely to be nearby), e.g. using NFC or cellular harvesting. Based on the sensed power harvesting level the display mode may be modified to show smaller text for readability by a user standing nearby (e.g. as defined by the sensed power harvesting level being above a threshold), rather than large text for readability by a user who is further away from the display (e.g. as defined by the sensed power harvesting level being below a threshold).

In an example, where the power harvesting hardware 102 harvests power from cellular signals generated by a proximate cellular device (e.g. a smartphone), if the sensed power harvesting level falls below a threshold, the display update hardware 106 may send a signal to the proximate cellular device which triggers that device to commence an operation which, as a by-product, causes an increase in the cellular emissions from the cellular device. For example, it may trigger a check for new email or updates, initiate a web search or other activity which requires the cellular device to communicate with the cellular base station.

Figure 8:
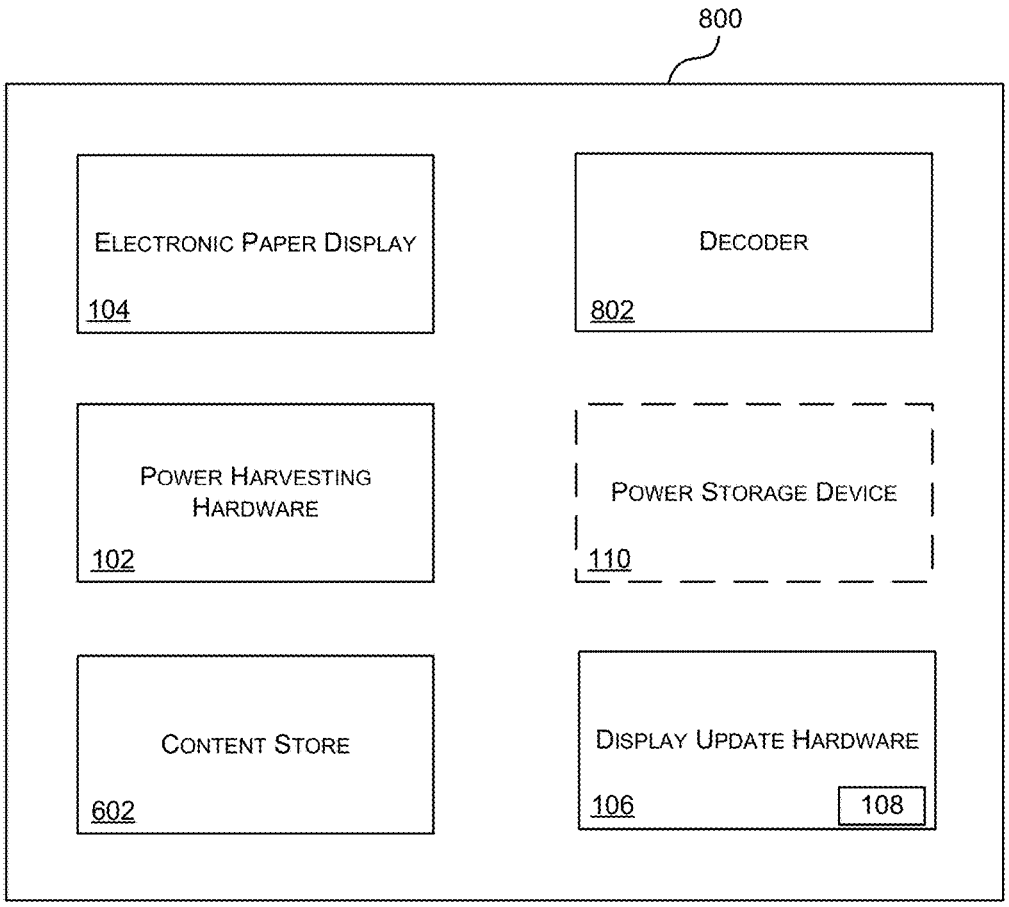
FIG. 8 is a schematic diagram of a further example display device comprising power harvesting hardware.

In addition to, or instead of, using the sensed power harvesting level to select an update mode (in block 204), determine when to switch on/off sensing hardware (in block 210) and/or trigger an action (in block 212), the sensed power harvesting level may be decoded to extract encoded data (block 214) and then the electronic paper display 104 may be updated based, at least in part, on the extracted data (block 216). The data which is encoded into the sensed power harvesting level (e.g. as a direct consequence of modulation of the source of harvested power) and subsequently extracted (in block 214) may comprise content data (e.g. new content for display on the electronic paper display) and/or control data (commands to trigger an update now or trigger an update at a specific time in the future or to update to a particular piece of content which is already stored locally to the electronic paper display, etc.). In such an example, the display update hardware 106 may comprise a decoding module or this may be provided as a separate module 802 within the display device 800 as shown in FIG. 8.

In such an example, the power harvesting hardware 102 may harvest RF emissions and the source of the RF emissions which are harvested may, for example be a nearby smartphone, tablet computer or other electronic device. The source of the RF emissions modulates the RF emissions (e.g. cellular emissions such as 3G or 4G or WiFi™ emissions), for example using amplitude modulation (AM), pulse width modulation (PWM) or pulse position modulation (PPM), although AM is susceptible to variations in received signal level due to the environment or other factors which interfere with and may mask the intended modulation of the transmitted RF signals. As a consequence of the RF emissions being modulated, the sensed power harvesting level (as detected in block 202) is also modulated. This modulated signal (i.e. the modulated sensed power harvesting level) is then decoded (block 214) to extract data and then this data is used to update the display (block 216), e.g. to display the new content data.

The modulated RF emissions may, for example, be generated by the source sending a particular data sequence via RF. In an example, an application may be installed on a source computing device which makes requests to a remote server and where these requests generate the modulated RF emissions, e.g. by sending a block of data followed by a gap, then another block of data, etc. where the lengths of the blocks and/or the lengths of the gaps are used to encode the data for use in updating the electronic paper display (e.g. length of blocks for PWM and length of gaps for PPM) and the data may simply be discarded by the receiving server (or other entity, such as the wireless access point or router). In another example, the information may be directly generated by a website called by the user, which generates subsequent requests to a remote server and thus modulates information. Therefore, any website with slight modifications to its source code (embedding a JavaScript file, or similar) could trigger a display change. Protection mechanisms may be implemented to avoid unwanted updates. Whilst Bluetooth® may also be used, this typically requires an established pairing between the source device and another device and so may be a less practical implementation than using cellular signals or WiFi™ signals.

Dependent upon the modulation scheme used by the source of the RF emissions, the RF emissions, and hence the sensed power harvesting level, may only encode a few bits per second of content data; however, this low rate data channel may be used to provide simple updates to a segmented or bitmapped electronic paper display, e.g. to show the number of unread emails or missed calls or to provide a simple weather forecast.

The encoding of data through the modulation of the power that is harvested is described above in relation to RF emissions and RF power harvesting. The methods may also be used for other sources of power in the environment and in particular sources of power generated by a proximate computing device (such as a mobile phone or tablet computer). For example, using ultrasound, light or mechanical vibrations.

Where ultrasound is used, the sound file which is used by a source device when providing a notification to a user (e.g. the ringtone or other alert) may be modified to include an inaudible high frequency component which can be harvested by the display device and which encodes data. Similarly where mechanical vibrations are used, the vibrating alert which is used to notify a user may be harvested by a display device which is physically coupled to the source device and the vibration sequence used may be modified to encode data.

Where light is used, the data may be encoded by modulating ambient light (e.g. using a shutter) or by modulating the light emissions from a source device, such as a mobile phone or tablet display or flashlight and examples are described below with reference to the example implementations shown in FIG. 9.

Figure 9:
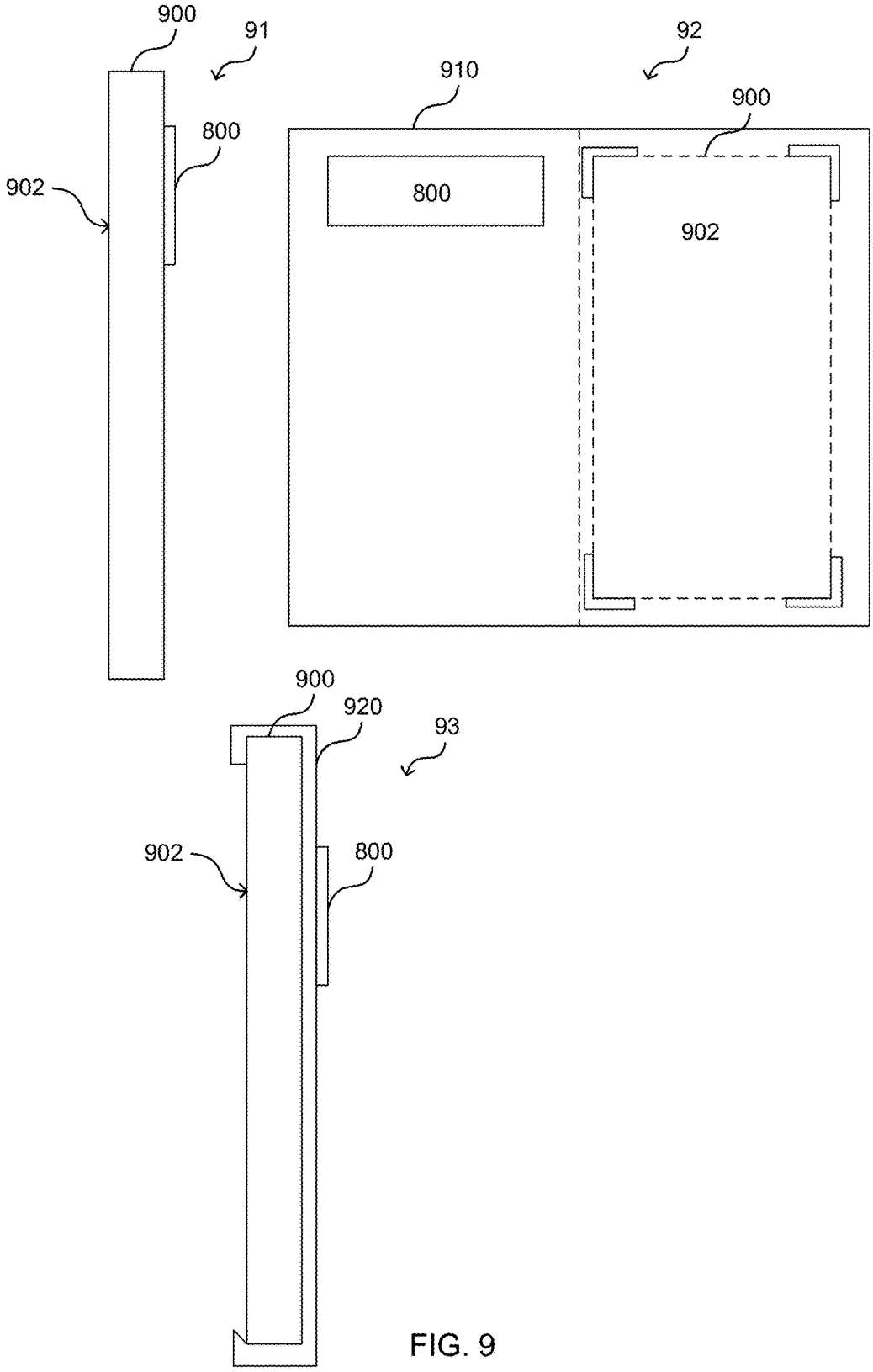
FIG. 9 shows schematic diagrams of example implementations of the display device shown in FIG. 8.

Three example implementations 91-93 are shown in FIG. 9. In a first example 91 (which is shown in cross-section), the display device 800 is physically, but not electrically, attached to the computing device 900 which is the source of the power that is harvested (e.g. the RF emissions, ultrasound, mechanical vibrations or light) and which may be a smartphone, tablet computer, etc. In the example shown, the display device 800 is attached to the rear of the device 900 (i.e. the face on the other side from the display face 902).

In an example where light is harvested, the display device 800 may be positioned on the rear of the device 900 such that a photodetector in the display device 800 is close to the flashlight on the device 900. This enables the display device 800 to harvest power from the flashlight (e.g. when photographs are taken) and the light from the flashlight may be modulated (e.g. at the start or end of the flash sequence and where this modulation may, in various examples, not be perceptible to a user) to encode data for the display device.

In the second and third examples 92, 93, the display device 800 is attached to a cover 910, 920 for the computing device 900 which is the source of the power that is harvested (e.g. the RF emissions, ultrasound, mechanical vibrations or light). In the second example 92 shown, the cover 910 is a flip cover (shown in plan view) such that the display device 800 and the display face 902 are visible to a user at the same time.

In an example where light is harvested, the display device 800 may be positioned on the flip cover 910 such that a photodetector in the display device 800 is close to the display face 902 when the cover is closed. This enables the display device 800 to harvest power from the display when the display is on and the cover is closed. Although typically the display will switch of automatically or be manually switched off when closing a flip cover, in this example, the intensity of the display may be modulated over a short period of time (e.g. just as the display switches on and/or off and where this modulation may, in various examples, not be perceptible to a user) to encode data for the display device. This may, for example, enable the display device 800 to be updated automatically each time a user closes or opens the flip cover 910. In addition, or instead, the display of the source device 900 may switch on periodically whilst the flip cover 910 is closed to communicate data to the display device 800 by modulating the intensity of the display.

In the third example 93, the cover 920 (shown in cross-section) fits closely around the device 900 which is the source of the power that is harvested (e.g. the RF emissions, ultrasound, mechanical vibrations or light) and the display device 800 is attached to the rear face of the cover 902. In the first and third examples 91, 93, the display device 800 and the display face 902 of the device 900 cannot be viewed at the same time.

The display update hardware 106 in the examples described herein may, for example, comprise one or more hardware logic components. For example, and without limitation, illustrative types of hardware logic components that can be used include processors, Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), Graphics Processing Units (GPUs). In an example, the display updated hardware 106 may comprise a sensor 108, a PMIC 610 for generating source/gate voltages, source and gate drivers, a display controller 612 (configured to control the source and gate drivers in such a way to display the image and execute the display update waveforms), a microcontroller 614 (configured to send image data to the display controller, enable and monitor the PMIC, and trigger the display controller to update the display) and a data store 616 arranged to store display update waveforms and other configuration data and cached image data, and a communication interface 618 which enables networking such that the display update hardware can receive new/updated image data. It will further be appreciated that some or all of these elements may be integrated onto a single integrated circuit (IC).

The display device 100, 600 described above may be implemented in many different form factors. In various examples, it may be part of a wearable device (e.g. a fitness band which is powered by the motion of the user wearing the band). In other examples, it may be a situated display (e.g. a noticeboard, sign, etc.) which harvests power from ambient light or RF signals (e.g. NFC or cellular). Such a situated display does not require an external power supply and so may be placed anywhere, including in remote places, and/or developing nations where there is scarce electricity supplies etc. In some examples the display device 100, 600 may be a very thin device (<1 mm thick) which can be placed in a conventional photograph frame and periodically update to show new images without requiring any user intervention (e.g. to charge the device or to trigger the updating of the displayed image).

In further examples, the display device 100, 600 may be mounted in/on a vehicle (e.g. on the handlebars of a bicycle and harvest kinetic energy associated with the motion of the bicycle). In an example, the display device 100, 600 may be an "always on" bicycle computer and the electronic paper display 104 is well suited to outdoor applications since it is easily readable in direct sunlight (unlike many emissive displays).

The display device 100, 600 described herein may provide a truly autonomous device, i.e. one which does not require any user interaction to charge the device or control the updating of the display. The content may be selected by a user via the display device or another computing device or the content may be selected autonomously too (e.g. by a content provider or by a content selection engine within the display device).

Although the present examples are described and illustrated herein as being implemented in a consumer electronic device, the display devices described are provided by way of an example and not a limitation. As those skilled in the art will appreciate, the present examples are suitable for application in a variety of different types of display devices and these may be integrated into any kind of larger device. Furthermore, as described above (and shown in FIG. 2) many different actions can be caused by the sensed power harvesting level (e.g. selecting an update mode in block 204, switching on/off sensing hardware in block 210, triggering another action in block 212 and decoding data in block 214) and any example device may implement any one of these method blocks or any combination of two or more of these method blocks.

A first further example provides display device comprising: an electronic paper display; power harvesting hardware; and display update hardware configured to control updating of the electronic paper display based at least in part on a sensed power harvesting level.

A second further example provides display device comprising: an electronic paper display; means for power harvesting; and means for controlling the updating of the electronic paper display based at least in part on a sensed power harvesting level.

In the first and second further examples, the sensed power harvesting level may be an indicator of an incoming power level from the power harvesting hardware in the first further example or means for power harvesting in the second further example.

The display device may further comprise a power storage device connected to the power harvesting hardware (or means for power harvesting in the second further example) such that the power harvesting hardware (or means for power harvesting in the second further example) can provide energy for storage in the power storage device and wherein the sensed power harvesting level is an indicator of a stored amount of energy in the power storage device.

The display update hardware may be configured to select, based at least in part on the sensed power harvesting level, an update mode from a set of candidate update modes.

One candidate update mode may not perform an update to the display. One (or at least one) of the candidate update modes may be configured to use a reduced applied voltage.

At least one of the candidate update modes may be a progressive update mode. A progressive update mode may be configured to update the display using a reduced number of colors. A progressive update mode may be configured to update the display using a subset of a driving waveform for the electronic paper display.

At least one of the candidate update modes may be a partial update mode. The display may comprise a plurality of pixels and a partial update mode may be configured to update only a proper subset of the pixels in the display. A partial update mode may be configured to render a small version of the content on only a portion of the display.

The display update hardware (or the means for controlling the updating of the electronic paper display in the second further example) may be configured to prevent updates to the display when the sensed power harvesting level falls below a threshold value.

The display device may further comprise a power storage device connected to the power harvesting hardware (or means for power harvesting in the second further example) and wherein the sensed power harvesting level is an incoming power level from the power harvesting hardware (or means for power harvesting in the second further example).

The display device may further comprise sensing hardware (or means for sensing in the second further example) and wherein the display update hardware (or the means for controlling the updating of the electronic paper display in the second further example) is further configured to activate and deactivate the sensing hardware (or means for sensing in the second further example) based on the sensed power harvesting level.

The sensed power harvesting level may be a modulated signal and the display device may further comprise a decoder configured to decode the sensed power harvesting level to extract data and wherein the display update hardware is configured to update the display based at least in part on the extracted data. The extracted data may be content data and the display update hardware may be configured to update the display using the extracted content data.

A third further example provides a method of operating a display device comprising: detecting a power harvesting level associated with power harvesting hardware in the display device; selecting an update mode from a set of candidate update modes based on the sensed power level; and updating an electronic paper display in the display device using the selected update mode.

For at least one candidate update modes, updating the electronic paper display may further comprise downloading updated content.

The method may further comprise activating and deactivating sensing hardware within the display device dependent upon the sensed power harvesting level.

A fourth further example provides an autonomous display device comprising: an electronic paper display; hardware for harvesting power from RF signals; and display update hardware configured to control how the electronic paper display is updated based on a sensed power harvesting level.

A fifth further example provides an autonomous display device comprising: an electronic paper display; means for harvesting power from RF signals; and means for controlling how the electronic paper display is updated based on a send power harvesting level.

The hardware for harvesting power from RF signals (or the means for harvesting power from RF signals in the fifth further example) may harvest cellular signals generated by a proximate cellular user device.

The sensed power harvesting level may be a modulated signal, the autonomous display device may further comprise a decoder configured to decode the sensed power harvesting level to extract data and wherein the display update hardware is configured to update the display using the extracted data. The extracted data may be content data.

The term 'computer' or 'computing-based device' is used herein to refer to any device with processing capability such that it can execute instructions. Those skilled in the art will realize that such processing capabilities are incorporated into many different devices and therefore the terms 'computer' and 'computing-based device' each include PCs, servers, mobile telephones (including smart phones), tablet computers, set-top boxes, media players, games consoles, personal digital assistants and many other devices.

The methods described herein may be performed by software in machine readable form on a tangible storage medium e.g. in the form of a computer program comprising computer program code means adapted to perform all the steps of any of the methods described herein when the program is run on a computer and where the computer program may be embodied on a computer readable medium. Examples of tangible storage media include computer storage devices comprising computer-readable media such as disks, thumb drives, memory etc. and do not include propagated signals. Propagated signals may be present in a tangible storage media, but propagated signals per se are not examples of tangible storage media. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

Any range or device value given herein may be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

The term 'subset' is used herein to refer to a proper subset such that a subset of a set does not comprise all the elements of the set (i.e. at least one of the elements of the set is missing from the subset).

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A display device, comprising:

an electronic paper display;

power harvesting circuitry for recovering energy from at least one of motion of the display device or one or more attributes of an environment surrounding the display device; and display update circuitry for:

controlling updating of content displayed on the electronic paper display based at least in part on a sensed power harvesting level; and selecting, based at least in part on the sensed power harvesting level, an update mode from a set of candidate update modes, the set of candidate update modes comprising at least one or more progressive update modes that update the electronic paper display by:

rendering the content using a first set of colors in a first display update and a second set of colors in one or more subsequent second display updates, wherein the second set of colors comprises a greater number of colors than the first set of colors;

for each pixel in the electronic paper display, applying different portions of a driving waveform over multiple display updates;

varying a refresh rate of the electronic paper display; or rendering a first amount of the content in a first display update and a second amount of the content in one or more subsequent second display updates, wherein the second amount of the content comprising a greater amount of content than the first amount of the content.

2. The display device according to claim 1, wherein the sensed power harvesting level is an indicator of an incoming power level from the power harvesting circuitry.

3. The display device according to claim 1, further comprising a power storage device connected to the power harvesting circuitry such that the power harvesting circuitry can provide energy for storage in the power storage device and wherein the sensed power harvesting level is an indicator of a stored amount of energy in the power storage device.

4. The display device according to claim 1, wherein the set of candidate modes further includes a candidate update mode that does not perform an update to the display.

5. The display device according to claim 1, wherein the set of candidate modes further includes a partial update mode.

6. The display device according to claim 5, wherein the electronic paper display comprises a plurality of pixels and the partial update mode is configured to update only a proper subset of the pixels in the electronic paper display.

7. The display device according to claim 6, wherein the partial update mode is configured to render a small version of the content on only a portion of the electronic paper display.

8. The display device according to claim 1, wherein the set of candidate modes includes a mode that is configured to use a reduced applied voltage.

9. The display device according to claim 1, wherein the display update circuitry prevents updates to the electronic paper display when the sensed power harvesting level falls below a threshold value.

10. The display device according to claim 9, further comprising a power storage device connected to the power harvesting circuitry and wherein the sensed power harvesting level is an incoming power level from the power harvesting circuitry.

11. The display device according to claim 1, further comprising sensing circuitry, wherein the display update circuitry activates and deactivates the sensing circuitry based on the sensed power harvesting level.

12. The display device according to claim 1, wherein:

the sensed power harvesting level is a modulated signal;

the display device further comprises a decoder circuit for decoding the sensed power harvesting level to extract data; and the display update circuitry updates the display based at least in part on the extracted data.

13. A method of operating a display device comprising:

detecting a power harvesting level associated with power harvesting circuitry in the display device;

selecting an update mode from a set of candidate update modes based on the sensed power level, the set of candidate update modes comprising at least one or more progressive update modes, wherein at least one progressive update mode is configured to update an electronic paper display by:

rendering the content using a first set of colors in a first display update and a second set of colors in one or more subsequent second display updates, wherein the second set of colors comprises a greater number of colors than the first set of colors;

for each pixel in the electronic paper display, applying different portions of a driving waveform over multiple display updates;

varying a refresh rate of the electronic paper display; or rendering a first amount of the content in a first display update and a second amount of the content in one or more subsequent second display updates, wherein the second amount of the content comprising a greater amount of content than the first amount of the content; and updating the electronic paper display in the display device using the selected update mode.

14. The method according to claim 13, wherein, for at least one candidate update mode in the set of candidate update modes, updating the electronic paper display further comprises downloading updated content.

15. An autonomous display device, comprising:

an electronic paper display;

circuitry for harvesting power from RF signals; and display update circuitry for controlling how the electronic paper display is updated based on a sensed power harvesting level based at least in part on an update mode selected from a set of candidate update modes, the set of candidate update modes comprising at least one or more progressive update modes that update the electronic paper display by:

rendering the content using a first set of colors in a first display update and a second set of colors in one or more subsequent second display updates, wherein the second set of colors comprises a greater number of colors than the first set of colors;

for each pixel in the electronic paper display, applying different portions of a driving waveform over multiple display updates;

varying a refresh rate of the electronic paper display; or rendering a first amount of the content in a first display update and a second amount of the content in one or more subsequent second display updates, wherein the second amount of the content comprising a greater amount of content than the first amount of the content.

16. The autonomous display according to claim 15, wherein the circuitry for harvesting power from RF signals harvests cellular signals generated by a proximate cellular user device.

17. The autonomous display device according to claim 15, wherein the sensed power harvesting level is a modulated signal, the autonomous display device further comprises a decoder circuit for decoding the sensed power harvesting level to extract data, and wherein the display update circuitry updates the electronic paper display based at least in part on the extracted data.

18. The method according to claim 13, wherein selecting the update mode from the set of candidate update modes based on the sensed power level comprises:

selecting a first progressive update mode when the sensed power level equals or exceeds a first threshold level; and selecting a different second progressive update mode when the sensed power level equals or exceeds a second threshold level that is greater than the first threshold level.

* * * * *